US009914009B2

(12) United States Patent
Tarkington et al.

(10) Patent No.: US 9,914,009 B2
(45) Date of Patent: Mar. 13, 2018

(54) EXERCISE DEVICES AND METHODS FOR EXERCISING AN ANKLE, FOOT, AND/OR LEG

(71) Applicant: TS MEDICAL LLC, McLean, VA (US)

(72) Inventors: Mary Anne Tarkington, McLean, VA (US); Peter-Christoph Tarkington Schmidt, McLean, VA (US); Hans J Schmidt, McLean, VA (US)

(73) Assignee: TS MEDICAL LLC, McLean, VA (US)

( * ) Notice: Subject to any disclaimer, the term of this patent is extended or adjusted under 35 U.S.C. 154(b) by 55 days.

(21) Appl. No.: 14/402,998

(22) PCT Filed: May 23, 2013

(86) PCT No.: PCT/US2013/042441
§ 371 (c)(1),
(2) Date: Nov. 21, 2014

(87) PCT Pub. No.: WO2013/181063
PCT Pub. Date: Dec. 5, 2013

(65) Prior Publication Data

US 2015/0165260 A1 Jun. 18, 2015

Related U.S. Application Data

(63) Continuation of application No. 13/482,844, filed on May 29, 2012, now Pat. No. 8,430,796.

(51) Int. Cl.
*A63B 24/00* (2006.01)
*A63B 21/00* (2006.01)
(Continued)

(52) U.S. Cl.
CPC ..... *A63B 21/143* (2013.01); *A63B 21/00189* (2013.01); *A63B 21/02* (2013.01);
(Continued)

(58) Field of Classification Search
CPC . A63B 21/026; A63B 21/0004; A63B 21/023; A63B 21/015; A63B 21/23;
(Continued)

(56) References Cited

U.S. PATENT DOCUMENTS 3,286,709 A 11/1966 Hoyer et al.
3,318,304 A 5/1967 Gurewich
(Continued)

FOREIGN PATENT DOCUMENTS

EP 2854958 A1 4/2015
GB 2 404 877 A 2/2005
(Continued)

OTHER PUBLICATIONS

Office Action dated Aug. 31, 2012 from U.S. Appl. No. 13/482,844.
(Continued)

*Primary Examiner* — Glenn Richman
(74) *Attorney, Agent, or Firm* — Jones Robb, PLLC

(57) ABSTRACT

An exercise device may include at least one pedal pivotably mounted to a leg rest portion and having a neutral position relative to a pivot axis. The pedal may be configured to rotate about the neutral pivot axis in a first direction away from the neutral position and in a second direction away from the neutral position. The devise may further include a counteracting force member configured to exert a force on the pedal about the pivot axis opposite to the respective first and second directions of rotation. The device may be adjustable to at least a first and a second configuration. In the first configuration, the pedal may be disposed in the neutral position to receive a foot of a user in a sitting position. In the
(Continued)

second configuration, the pedal may be disposed in the neutral position to receive a foot of a user in a supine position.

26 Claims, 11 Drawing Sheets

(51) Int. Cl.

| | |
|---|---|
| ***A63B 21/02*** | (2006.01) |
| ***A63B 21/045*** | (2006.01) |
| ***A63B 23/08*** | (2006.01) |
| ***A63B 23/035*** | (2006.01) |
| *A63B 22/00* | (2006.01) |

(52) U.S. Cl.
CPC ..... *A63B 21/026* (2013.01); *A63B 21/045* (2013.01); *A63B 21/4015* (2015.10); *A63B 21/4033* (2015.10); *A63B 21/4034* (2015.10); *A63B 21/4047* (2015.10); *A63B 23/03541* (2013.01); *A63B 23/08* (2013.01); *A63B 2022/0097* (2013.01); *A63B 2208/0233* (2013.01); *A63B 2208/0252* (2013.01); *A63B 2209/10* (2013.01); *A63B 2210/50* (2013.01)

(58) Field of Classification Search
CPC ..... A63B 21/085; A63B 21/03533; A63B 21/4047; A63B 21/4033; A63B 21/4015; A63B 21/4034; A63B 21/02; A63B 21/045; A63B 21/143; A63B 21/00189; A63B 21/26; A63B 23/08; A63B 23/03541; A63B 2209/10; A63B 2210/50; A63B 2208/0233; A63B 2208/0252; A61H 1/024; A61H 1/0259; A61H 1/0214; A61H 1/008
See application file for complete search history.

(56) References Cited

U.S. PATENT DOCUMENTS

| | | | | | |
|---|---|---|---|---|---|
| 4,111,416 | A * | 9/1978 | Jinotti | A63B 21/023 | 482/128 |
| 4,422,635 | A * | 12/1983 | Herod | A63B 23/03533 | 248/464 |
| 4,637,379 | A | 1/1987 | Saringer | | |
| 4,669,722 | A | 6/1987 | Rangaswamy | | |
| 4,795,148 | A * | 1/1989 | Rangaswamy | A63B 23/085 | 482/123 |
| 4,979,737 | A * | 12/1990 | Kock | A63B 21/015 | 482/118 |
| 5,038,758 | A * | 8/1991 | Iams | A61H 1/008 | 482/57 |
| 5,129,872 | A * | 7/1992 | Dalton | A63B 21/026 | 482/127 |
| 5,230,681 | A * | 7/1993 | Hannum et al. | A63B 21/026 | 48/79 |
| 5,611,770 | A | 3/1997 | Tesch | | |
| 5,645,516 | A * | 7/1997 | Foster | A63B 21/0004 | 482/121 |
| 6,244,992 | B1 | 6/2001 | James | | |
| 6,569,213 | B1 | 5/2003 | Busch | | |
| 6,780,142 | B1 | 8/2004 | Takizawa et al. | | |
| 6,808,476 | B2 * | 10/2004 | Zagone | A63B 21/023 | 482/123 |
| 6,837,831 | B2 * | 1/2005 | Lee | A61H 1/0214 | 482/57 |
| 7,008,357 | B2 | 3/2006 | Winkler | | |
| 7,322,904 | B2 | 1/2008 | Takizawa et al. | | |
| 7,364,534 | B2 | 4/2008 | Zoller et al. | | |
| 7,481,739 | B2 * | 1/2009 | Takizawa | A61H 1/0259 | 482/70 |
| 7,481,751 | B1 | 1/2009 | Arnold | | |
| 7,641,591 | B2 | 1/2010 | Takizawa et al. | | |
| 7,775,941 | B2 | 8/2010 | Nguyen et al. | | |
| 7,883,451 | B2 | 2/2011 | Hand | | |
| 8,029,420 | B1 | 10/2011 | Thati | | |
| 8,092,350 | B2 | 1/2012 | Chinag | | |
| 8,430,796 | B1 | 4/2013 | Tarkington et al. | | |
| D726,844 | S * | 4/2015 | Mathew | D21/685 | |
| 2003/0060339 | A1 | 3/2003 | Ravikumar | | |
| 2005/0251067 | A1 | 11/2005 | Terry | | |
| 2006/0122040 | A1 | 6/2006 | Nguyen et al. | | |
| 2010/0145233 | A1 * | 6/2010 | Zhang | A61B 5/1124 | 600/592 |
| 2010/0222180 | A1 * | 9/2010 | Takizawa | A61H 1/024 | 482/8 |
| 2011/0046524 | A1 | 2/2011 | Mihara et al. | | |
| 2011/0077560 | A1 | 3/2011 | Jacofsky et al. | | |
| 2014/0336009 | A1 * | 11/2014 | Piaget et al. | A61H 1/024 | 601/24 |
| 2015/0314157 | A1 * | 11/2015 | Lampert et al. | A63B 21/0004 | 482/121 |

FOREIGN PATENT DOCUMENTS

| | | | |
|---|---|---|---|
| JP | 2009254700 | A | 11/2009 |
| WO | WO 2009/128565 | A1 | 10/2009 |
| WO | WO 2013/181063 | A1 | 12/2013 |

OTHER PUBLICATIONS

Response dated Nov. 28, 2012 from U.S. Appl. No. 13/482,844.
International Search Report for International Application No. PCT/US2013/042441, dated Sep. 6, 2013.
Written Opinion for International Application No. PCT/US2013/042441, dated Sep. 6, 2013.
Office Action in Canadian Patent Application No. 2,874,237 dated Dec. 10, 2015.
Communication pursuant to Article 94(3) EPC dated Mar. 20, 2017 in co-pending European Patent Application No. 13 727 007.0.

* cited by examiner

EXERCISE DEVICES AND METHODS FOR EXERCISING AN ANKLE, FOOT, AND/OR LEG

CROSS REFERENCE TO RELATED APPLICATIONS

This application is a national stage application of PCT/US2013/042441, filed internationally on May 23, 2013, which claims priority to U.S. patent application Ser. No. 13/482,844 (filed on May 29, 2012; now U.S. Pat. No. 8,430,796), each of which is incorporated herein by reference in its entirety.

TECHNICAL FIELD

The present teachings relate to exercise devices and methods for exercising an ankle, foot and/or leg. More particularly, the present teachings relate to exercise devices and methods for exercising muscles in the ankle, foot, and/or leg of a user to increase blood circulation, which may, for example, assist in preventing venous thromboembolism.

INTRODUCTION

The section headings used herein are for organizational purposes only and are not to be construed as limiting the subject matter described in any way.

Venous thromboembolism (VTE) occurs when red blood cells, fibrin and, to a lesser extent, platelets and leukocytes, form a mass (i.e., clot) within an intact vein. The thrombus (i.e., blood clot) is referred to as a deep venous thrombosis (DVT) when formed within the deep veins of the legs or in the pelvic veins. A pulmonary embolism (PE) results when a piece of thrombus detaches from a vein wall, travels to the lungs, and lodges within the pulmonary arteries.

VTE is often a concern in situations where an individual is immobile and/or relatively nonambulatory for a relatively long period of time, such as, for example, during hospitalization, after surgery, during pregnancy and/or in the postpartum period, while traveling (e.g., in a car, plane and/or train), at work, and/or in a more sedentary lifestyle (e.g., the elderly and/or obese). Blood returning to the heart does so through veins. Large veins, such as those found in the legs, lie near and between muscles and contain valves that maintain the flow of blood in the direction of the heart by preventing backflow and stasis. The contraction of these muscles (e.g., through walking) forces the blood through the veins in the direction of the heart, usually against the force of gravity, thereby preventing blood from accumulating in the extremities. If these muscles are not used and/or minimally (e.g., infrequently) used for an extended period of time, however, the lower limbs may swell with stationary blood, greatly increasing the risk of VTE.

Because of this potential danger, preventative measures against VTE have become standard, for example, in prolonged hospitalizations and postoperative care. Consequently, in conjunction with early ambulation, a number of other prophylaxis devices have been developed to help prevent VTE. Graduated compression stockings, for example, which gradually apply a decreasing amount of pressure as a stocking moves up a leg (i.e., from ankle to thigh), help to squeeze or push blood back up the leg in an effort to counteract pooling. Such stockings, although inexpensive, are difficult to put on and take off a patient, generally requiring staff assistance and potentially representing an even greater challenge in outpatient settings.

Intermittent pneumatic compression devices, which generally comprise a cuff that slides over the leg, provide undulating compression to the calf muscle to help drive blood back to the heart. Such devices, however, are expensive and cumbersome, and are in some cases stored in a central storeroom and thus not readily available on the hospital floor and/or outside of a medical setting. Pneumatic compression devices also require significant staff input, which is exacerbated by the need to disconnect the unit anytime the patient is moved, resulting in poor compliance with the prophylaxis regime. Furthermore, since compressive techniques fail to treat and articulate a patient's ankle and/or knee joints, or otherwise contract the ankle, foot and/or leg (e.g., calf) muscles, such methods have limited exercise and therapy capabilities, being impractical for use outside of a hospital setting.

Various additional exercise devices serve to articulate a patient's joints, thereby providing joint therapy while contracting the muscles of the ankle, foot, and/or leg to prevent blood from accumulating in the lower extremities of the body. Some such devices, however, may be difficult for non-ambulatory patients, being used in a standing position and/or providing no leg support when in use. Furthermore, such devices generally do not simulate full ambulation (i.e., the full walking cycle), providing both plantar flexion (i.e., movement which increases the approximate 90° angle between the front part of the foot and the shin, thereby contracting the calf muscle) and dorsiflexion motion (i.e., movement which decreases the angle between the front part of the foot and the shin, thereby stretching the calf muscle). Many of these devices also are cumbersome, complex and expensive; being impractical for use during transition care or between care locations, or for use by other VTE at-risk groups (e.g., travelers).

Due to growing concerns over the continued prevalence of VTE related medical cases, it may be desirable to provide a relatively simple, inexpensive exercise device and method with full exercise and therapy capabilities, which simulates full ambulation to increase blood circulation in the lower extremities of the body. It may also be desirable to provide a device and method that promotes continuous use, provides an effective visual link as a reminder to perform desired exercises, and/or that transitions relatively seamlessly between inpatient and outpatient settings. It also may be desirable to provide a device that is portable, being useful for all VTE at-risk individuals. It may further be desirable to provide a device and method that can be relatively easily used by individuals of various strengths.

SUMMARY

The present teachings may solve one or more of the above-mentioned problems and/or may demonstrate one or more of the above-mentioned desirable features. Other features and/or advantages may become apparent from the description that follows.

In accordance with various exemplary embodiments of the present teachings, an exercise device comprises at least one pedal pivotably mounted to a leg rest portion and having a neutral position relative to a pivot axis. The pedal is configured to rotate about the pivot axis in a first direction and a second direction opposite the first direction. The exercise device further comprises a resistance mechanism configured to exert a torque on the pedal opposite to a direction of rotation of the pedal about the pivot axis and away from the neutral position. The device is adjustable to at least a first configuration wherein the pedal is disposed in the neutral position to receive a foot of a user in a sitting position, and a second configuration wherein the pedal is disposed in the neutral position to receive a foot of a user in a supine position.

In accordance with various additional exemplary embodiments of the present teachings an exercise device comprises at least one pedal pivotably mounted to a leg rest portion. The pedal has a neutral position relative to a pivot axis and is configured to rotate about the pivot axis in a first direction and a second direction opposite the first direction. The exercise device further comprises a resistance mechanism configured to exert a passive resistance torque on the pedal about the pivot axis opposite to a direction of rotation of the pedal about the pivot axis, wherein an amount of the torque varies with a degree of rotation of the pedal about the pivot axis.

In accordance with various further exemplary embodiments of the present teachings a method for exercising muscles in an ankle, foot, and/or leg of a user comprises adjusting a position of a leg rest portion to one of a first configuration to accommodate a user in a sitting position and a second configuration to accommodate a user in a supine position. The method further comprises releasably securing at least one foot of the user onto at least one pedal pivotably mounted to the leg rest portion, the pedal having a neutral position relative to a pivot axis. The method further comprises rotating the pedal with the at least one foot in first and second opposite directions about the pivot axis against a torque exerted against the pedal in a direction opposite to the rotating direction.

Additional objects and advantages will be set forth in part in the description which follows, and in part will be obvious from the description, or may be learned by practice of the present teachings. The objects and advantages may be realized and attained by means of the elements and combinations particularly pointed out in the appended claims and their equivalents.

It is to be understood that both the foregoing general description and the following detailed description are exemplary and explanatory only and are not restrictive of the present teachings and claims.

BRIEF DESCRIPTION OF THE DRAWINGS

The present teachings can be understood from the following detailed description either alone or together with the accompanying drawings. The drawings are included to provide a further understanding, and are incorporated in and constitute a part of this specification. The drawings illustrate one or more exemplary embodiments of the present teachings and together with the description serve to explain various principles and operations.

DESCRIPTION OF VARIOUS EXEMPLARY EMBODIMENTS

Various conventional thromboprophylaxis techniques typically rely on devices that are cumbersome, complex, and/or expensive. Consequently, such devices may be underutilized during hospitalization and become impractical for use during transition care or between care locations, or for use by other vulnerable groups, such as, for example, travelers and/or other individuals sitting or lying for extended periods. To increase thromboprophylaxis utilization, various exemplary embodiments of the present teachings provide exercise devices and methods of exercising an ankle, foot and/or leg that provide simple and relatively inexpensive prophylaxis by simulating full ambulation to increase blood circulation in the lower extremities of the body. In various exemplary embodiments, exercise devices and methods for exercising an ankle, foot and/or leg use at least one pedal pivotably mounted to a leg rest portion and having a neutral position relative to a pivot axis, the pedal being configured to rotate about the pivot axis in a first direction and a second direction opposite the first direction, wherein the device is also adjustable to at least two configurations to accommodate a user, for example, in either a sitting or supine position.

Figure 1:
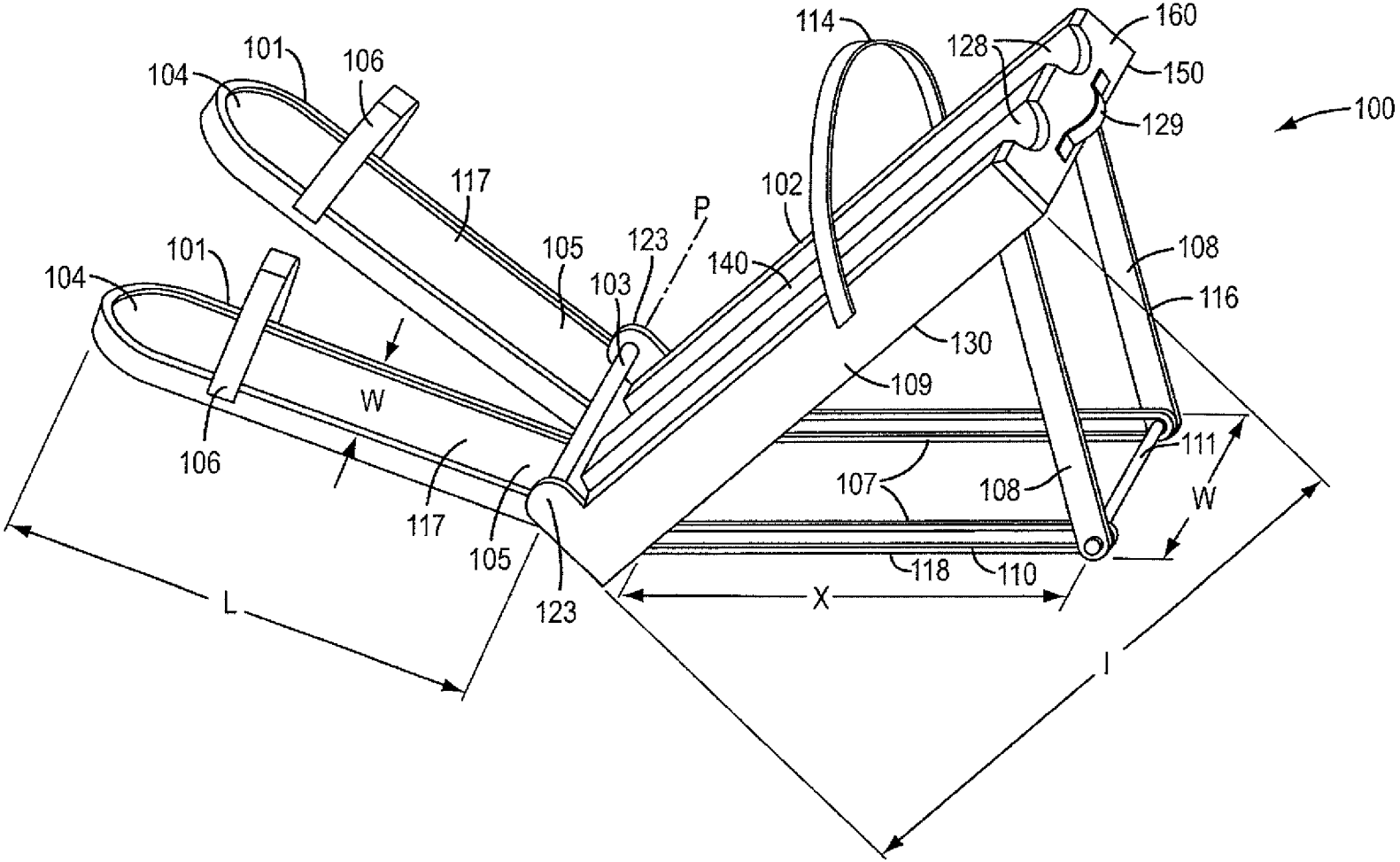
FIG. 1 is a perspective side view of an exemplary embodiment of an exercise device in accordance with the present teachings.

As illustrated in the exemplary embodiments shown in the drawings, an exercise device in accordance with the present teachings includes three main parts: 1) a leg rest portion, 2) one or more pedals extending from the leg rest portion, and 3) a stand portion connected to the leg rest portion, which is configurable to transition the exercise device between configurations. FIG. 1 illustrates an exemplary exercise device 100 in accordance with an exemplary embodiment of the present teachings. As shown in FIG. 1, the exercise device 100 includes a leg rest portion 102, one or more pedals 101 (two pedals 101 being shown in the embodiment of FIG. 1), and a stand portion 116. The leg rest portion 102 can provide a base from which the pedals 101 extend. As shown, the pedals 101 can extend from an end of the leg rest portion 102 and be pivotably mounted relative to the leg rest portion 102, as will be described in further detail below. In the orientation of FIG. 1, the leg rest portion 102 can provide an upper surface 140 configured to receive and support the legs of a user, as will be described in more detail below, and a lower surface 150 to which upright members 108 of the stand portion 116 can attach to place the leg rest portion 102 in the position shown.

Figure 2:
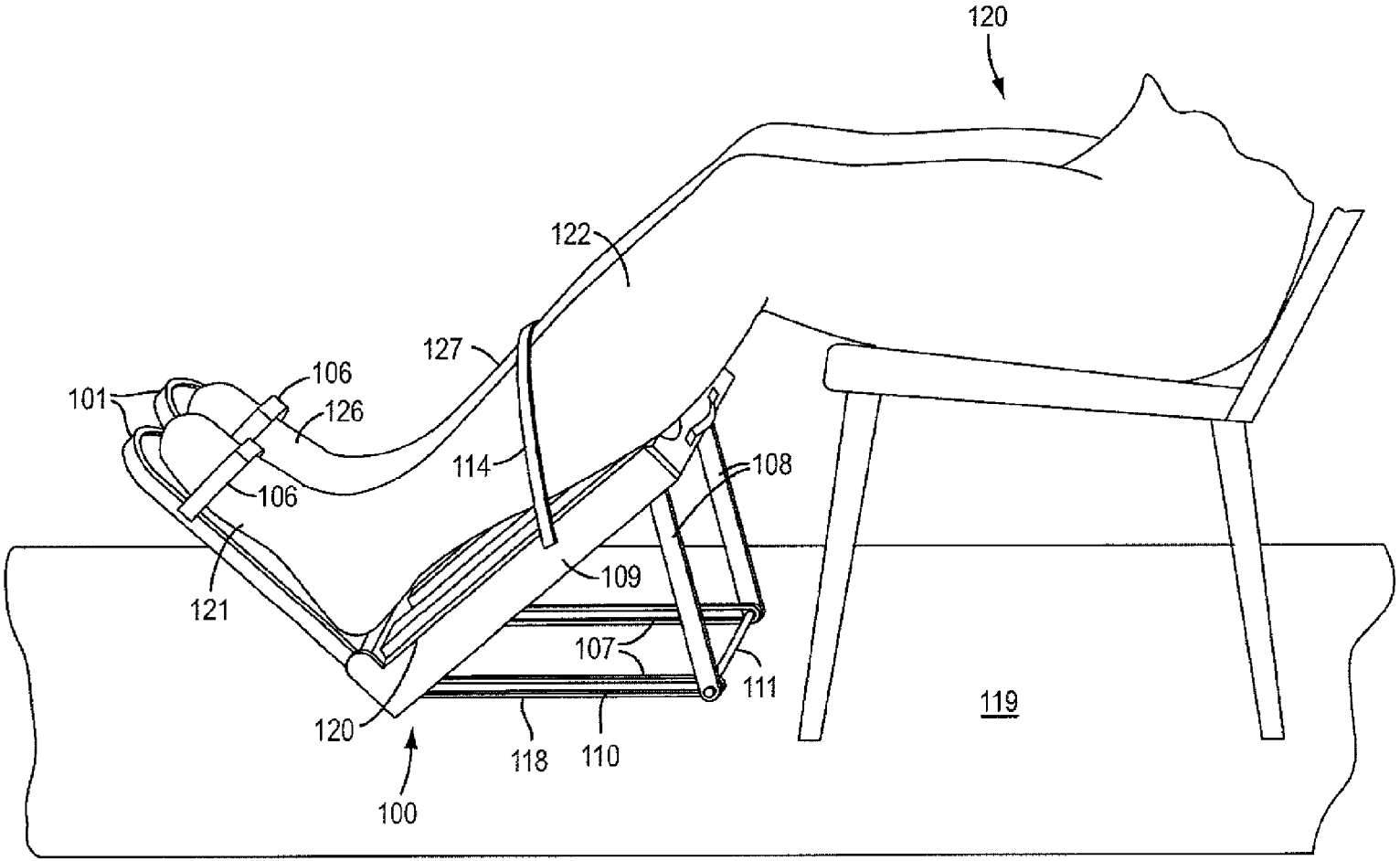
FIG. 2 is a perspective side view of the device of FIG. 1 in a first configuration for using the device.
Figure 3:
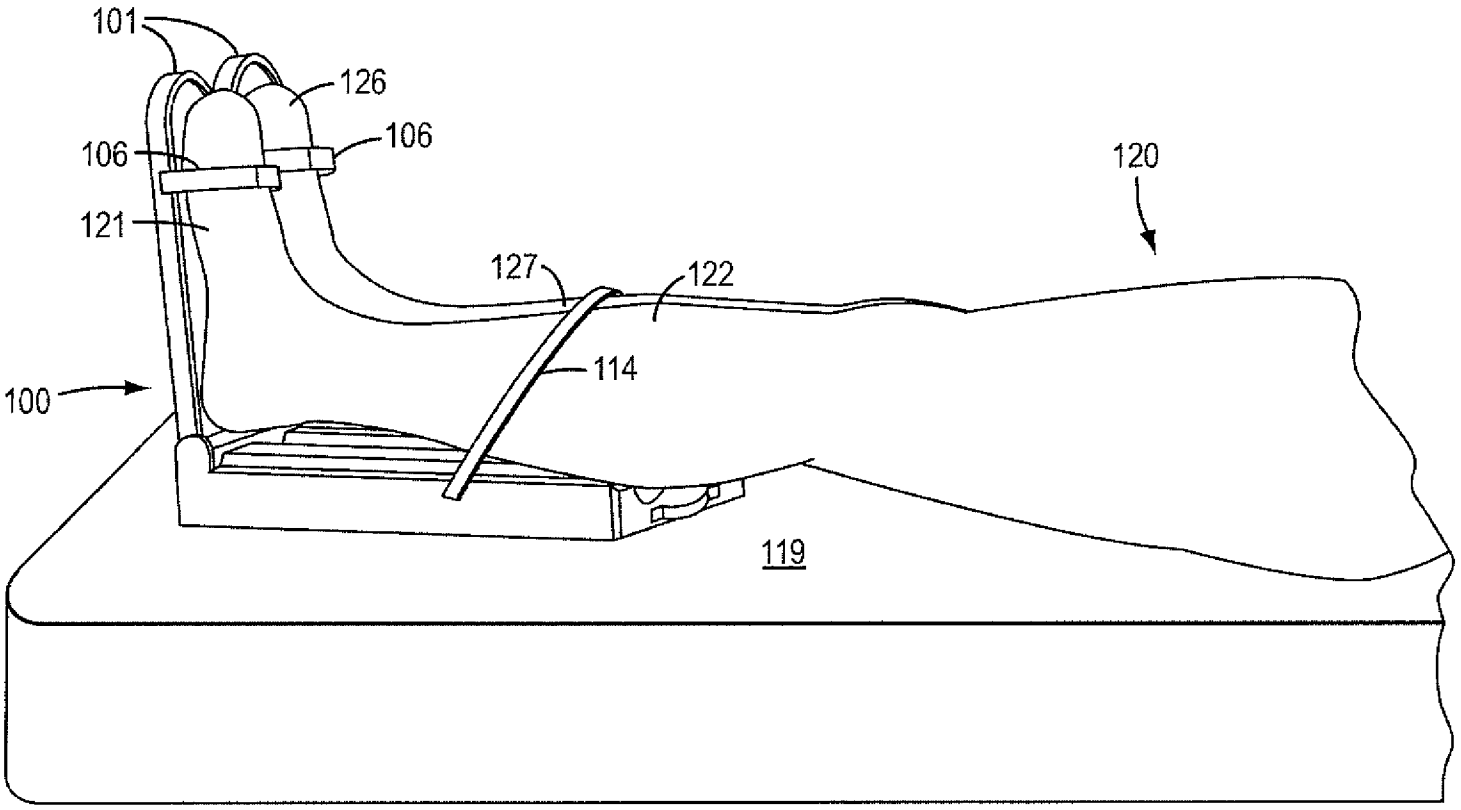
FIG. 3 is a perspective side view of the device of FIG. 1 in a second configuration for using the device.

As illustrated, for example, in FIGS. 2 and 3, in various exemplary embodiments of the present teachings, to better accommodate non-ambulatory users, the leg rest portion 102 may be configured to support a left leg 122 and a right leg 127 of a user 120 while the user 120 is using the device 100. Thus, the leg rest portion 102 may be formed from any material and/or combination of materials suitable for mounting the pedals 101 and/or supporting the legs of a user in accordance with the present teachings. In various exemplary embodiments, the leg rest portion 102 may, for example, comprise a molded plastic material, such as, for example, a molded polypropylene material. Those ordinarily skilled in the art will understand, however, that the leg rest portion 102 may be made of various plastic materials, as well as various other materials, including, for example, wood and/or metal materials. Suitable materials can include, for example, materials that are relatively light so as to facilitate carrying the device 100, yet durable and able to withstand repetitive use.

As shown in FIGS. 1-3, for example, the leg rest portion 102 may include an upper surface provided with shaped depressions 128 configured to receive the legs 122 and 127 of the user 120, being appropriately sized and/or configured to accommodate a range of user weights and/or heights (e.g., one size fits all). In various exemplary embodiments, for example, the leg rest portion 102 can have a length l ranging from about 10 inches to about 18 inches, for example, about 12 inches to about 15 inches. To more comfortably accommodate various users, in various additional embodiments, the depressions 128 may be removably mountable and come in multiple sizes. In various further embodiments, the depressions 128 may be made from a soft, form fitting material, such as, for example, a shape memory polymer, which may form to different users as well as promote hygiene as would be understood by those of ordinary skill in the art.

As shown in FIG. 1, in various exemplary embodiments, the leg rest portion 102 may further comprise at least one strap 114 affixed to respective sides 109 of the leg rest portion 102. As shown in FIGS. 2 and 3, the strap 114 may be configured to releasably secure around the legs 122 and 127 of the user 120 to assist in holding the legs 122, 127 in position. By way of example only, in various embodiments, the strap 114 may comprise hook and loop fasteners, such as, for example, Velcro®. Those ordinarily skilled in the art will further understand that the strap 114 may comprise any type and/or configuration of mechanism to releasably secure the legs 122 and 127 of the user 120 to the leg rest portion 102, including for example, cuffs, snaps, buttons, ties, buckles, elastic bands and/or any combination thereof.

To comfortably accommodate a range of user heights, in various exemplary embodiments, the sides 109 of the leg rest portion 102 may further comprise an adjustment mechanism (not shown) to adjust a position of the pedals 101 along the leg rest portion 102. As shown with respect to the exemplary embodiment of FIGS. 7-11, for example, in various embodiments, the adjustment mechanism may comprise a track 230 on each side 209 of the leg rest portion 202, in which a pin 235 may slide to adjust the position of pedals 201. Those ordinarily skilled in the art will understand, however, that the adjustment mechanism may comprise various types and/or configurations of mechanisms to adjust the position of the pedals 101 on the leg rest portion 102.

Those ordinarily skilled in the art will further understand that the leg rest portion 102 may have various sizes, shapes, configurations and/or features without departing from the scope of the present teachings. In various embodiments, for example, the leg rest portion 102 may also include various cushioning and/or shock mechanisms to increase user comfort.

The pedals 101 may be formed from any material suitable for receiving and/or supporting the foot of a user in accordance with the present teachings. In various exemplary embodiments, the pedals 101 may, for example, comprise a molded plastic material, such as, for example, a molded polypropylene material. Those ordinarily skilled in the art will understand, however, that the pedals 101 may be made of various plastic materials, as well as various other materials, including, for example, wood and/or metal materials. Suitable materials can include, for example, materials that are relatively light so as to facilitate carrying the device 100, yet durable and able to withstand repetitive use/motion.

As illustrated in FIGS. 2 and 3, the pedals 101 can be shaped to receive a user's feet, for example, a left foot 121 and a right foot 126, respectively, of the user 120. The pedals 101 can be sized to accommodate a range of foot and/or shoe sizes. In various exemplary embodiments of the present teachings, for example, each of the pedals 101 can have a length L ranging from about 8 inches to about 20 inches, for example from about 12 inches to about 14 inches, and a width W ranging from about 2 inches to about 7 inches, for example, about 3 inches to about 5 inches. In various additional exemplary embodiments, as shown in FIGS. 1-3, the pedals 101 may each comprise a foot rest 117 having a toe end portion 104 and a heel end portion 105. Those ordinarily skilled in the art will understand, however, that the pedals 101 may have various sizes, shapes, configurations and/or features without departing from the scope of the present teachings.

As shown in FIG. 1, for example, in various exemplary embodiments, the device 100 may further comprise at least one strap 106 affixed to each of the pedals 101. As shown in FIGS. 2 and 3, the straps 106 may be configured to releasably secure the left foot 121 and the right foot 126 of the user 120 respectively to the pedals 101. The straps 106 can be adjustable to permit loosening and tightening of the straps around a user's feet. By way of example only, in various embodiments, the straps 106 may comprise hook and loop fasteners, such as, for example, Velcro®. Those ordinarily skilled in the art will further understand that the straps 106 may comprise any type and/or configuration or mechanism to releasably secure the left foot 121 and the right foot 126 of the user 120 respectively to the pedals 101, including for example, snaps, buttons, ties, buckles, elastic bands and/or any combination thereof. To further prevent foot slippage and/or increase user comfort, in various additional exemplary embodiments, the foot rest 117 of the pedals 101 may also include various ridges, treads, coatings, applied surfaces, and/or other mechanisms to increase friction on the surface of the pedals 101 with which the foot comes into contact, for example, to prevent a user's foot from slipping on the surface of the pedal 101.

As illustrated in FIG. 1, the pedals 101 may be pivotably mounted to the leg rest portion 102 via a resistance mechanism. As shown, the heel portion 105 can be attached to a resistance mechanism in the form of a torsion bar 103. The torsion bar 103 can be supported at its ends by flanges 123 disposed at a bottom edge and projecting upwardly from the upper surface 140 of the leg rest portion 102. In this manner, the pedals 101 are able to pivot toward and away from the upper surface 140 of the leg rest and can have a neutral position relative to a pivot axis P (see right pedal 101 in FIG. 1). As used herein, the term "neutral position" refers to a pedal starting position and a position of the pedal without external forces acting thereon to pivot the pedal about the pivot axis (e.g., about the torsion bar 103). Thus, when a pedal is in the "neutral position," the leg of a user, which is received by the pedal, is in a relaxed, un-flexed position (i.e., the user's half muscle is neither contracted nor stretched). In the exemplary embodiment of FIG. 1, in the "neutral position", the pedal 101 is positioned at approximately 90 degrees relative to the upper surface 140 of the leg rest portion 102. As will be described in further detail below with reference to FIGS. 4A and 4B, the pedals 101 are configured to rotate about the pivot axis P in a first direction toward the upper surface 140 of the leg rest portion 102 and in a second direction away from the upper surface 140 of the leg rest portion 102.

The torsion bar 103 is configured to resist an amount of torque that is placed upon it. Thus, as the torsion bar 103 is rotated about the pivot axis P (via a pedal 101), the torsion bar 103 may store a torque T (i.e., the stored torque T is substantially equal to the amount of torque placed upon the torsion bar 103), so that when the torque is removed from the torsion bar 103 the pedal 101 may quickly return to its starting position (i.e., the neutral position). In this manner, the torsion bar 103 is configured to exert a stored torque T on the pedals 101 opposite to the direction of rotation (toward or away from the upper surface 140 of the leg rest portion 102) of the pedals 101 about the pivot axis P. In various exemplary embodiments, the amount of stored torque T (counteracting torque) respectively exerted by the torsion bar 103 on the pedals 101 is proportional to the amount by which the pedals 101 are rotated about the pivot axis P and away from the neutral position.

Accordingly, in various exemplary embodiments of the present teachings, the torque exerted by the torsion bar 103 may provide passive resistance to rotational movement of the pedals 101 in both directions about the respective pivot axis P. And, in various additional embodiments, an amount of the torque may vary with a degree of rotation θ (see FIGS. 4A and 4B) of the pedals 101 about the pivot axis P, for example, the amount of torque may increase with the degree of rotation θ of the pedals 101 about the respective pivot axis P.

Those of ordinary skill in the art would understand, however, that resistance mechanisms in accordance with the present teachings may comprise various types, numbers and/or configurations of flexible, elastic objects, which store mechanical energy when the pedals 101 are pivoted about the pivot axis P. Examples of such resistance mechanisms other than torsion bars that can be used include but are not limited to, for example, torsion springs and/or linear springs. Furthermore, resistance mechanisms in accordance with the present teachings may be formed from any material suitable for such elastic energy storage, such as, for example, rubber and/or metal materials. Those ordinarily skilled in the art will understand, however, that the resistance mechanisms may comprise any mechanism and/or object, formed from any material, that can elastically deform under the stress placed upon it by the respective rotation of the pedals 101, while causing a counteracting torque against the pedals 101.

To accommodate users in various positions, as illustrated in FIGS. 2 and 3, the device 100 may be adjustable to at least two configurations. As shown in FIG. 2, the device 100 may be adjusted to a first configuration wherein the pedals 101 are disposed in the neutral position to respectively receive the left foot 121 and the right foot 123 of a user 120 in a sitting position. Alternatively, as shown in FIG. 3, the device 100 may be adjusted to a second configuration wherein the pedals 101 are disposed in the neutral position to respectively receive the left foot 121 and the right foot 123 of a user 120 in a supine position.

Thus, in various exemplary embodiments, the device 100 includes a collapsible stand portion 116 configured to have a first expanded configuration that permits the device 100 to be placed in the configuration shown in FIG. 2 for use in a sitting position in which the leg rest portion 102 is supported at an incline relative to a flat surface. In a second collapsed configuration, the stand portion 116 permits the device 100 to be placed in the configuration shown in FIG. 3 for use in a supine position, as well as for carrying the device 100 (see FIG. 5). The stand portion 116 can include base members 107 and upright members 108. As shown in FIGS. 1 and 2, when the device 100 is in the first configuration, the leg rest portion 102 may interconnect the base members 107 and the upright members 108 to form a triangular structure to receive the legs 122 and 127 of the user 120 in a sitting position. As shown in FIG. 6, in the collapsed second configuration, in various embodiments, for example, the members 107 and 108 are pivotably connected via pins 155 to inner edges 152 of the lower surface 150 of the leg rest portion 102. Thus, the base members 107 and the upright members 108 may rotate out from the lower surface 150 of the leg rest portion 102. Furthermore, base members 107 may respectively comprise tracks 110 (shown best in FIGS. 1 and 2) for sliding a positioning bar 111, which connects the upright members 108, out from the leg rest portion 102 to form the triangular structure. Thus, while in the first configuration, the device 100 may be placed, for example, on the floor in front of a seated user. As one of ordinary skill in the art would understand, while in the first configuration, the device 100 may have one position or multiple positions. In various embodiments, for example, the positioning bar 111 may be adjustable within the tracks 110 to provide the leg rest portion 102 with varying levels of inclination. As would be understood by one of ordinary skill in the art, in various exemplary embodiments, the positioning bar 111 may be friction fit within the tracks 110. In various additional embodiments, various locking mechanism can be used to prevent movement of the positioning bar 111 within the tracks 110, as would also be understood by those of ordinary skill in the art.

As shown in FIGS. 3 and 6, when the device 100 is in the second configuration, the base members 107 and the upright members 108 may rotate so as to collapse the stand portion 116 to place it in a position lying substantially flat against the lower surface 150 of the leg rest portion 102. In this collapsed configuration of the stand portion 116, the device can be placed into a configuration to receive the legs 122 and 127 of the user 120 in a supine position, as depicted in FIG. 3 for example. Thus, while in the second configuration, the device 100 may be placed, for example, on a mattress, a couch, a floor and/or other flat surface under the legs of a supine user.

In various exemplary embodiments of the present teachings, the base members 107 may be configured to support the device 100 against a support surface 119 (e.g., the floor and/or mattress) while the user 120 is using the device 100. In various embodiments, for example, the base members 107 can have a length x ranging from about 12 inches to about 14 inches and an overall width w ranging from about 10 inches to about 14 inches. Those of ordinary skill in the art would understand, however, that the base members 107 may have various lengths and widths that provide sufficient stability to support the weight of the user's legs 122 and 127 when the device 100 is in the first expanded configuration. In various additional embodiments, a bottom portion 118 of the base members 107 (i.e., the portion of each base member 107 that comes into contact with the support surface 119) may include various slip resistant materials, such as, for example, rubber strips, to prevent the device 100 from slipping, for example, on the support surface 119.

Figure 5:
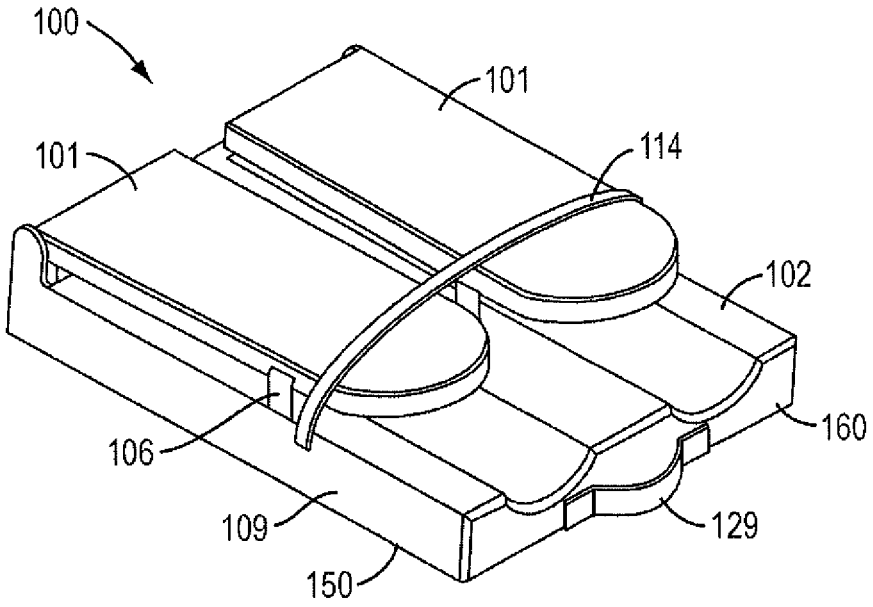
FIG. 5 is a top perspective view of the device of FIG. 1 in a portable configuration.
Figure 6:
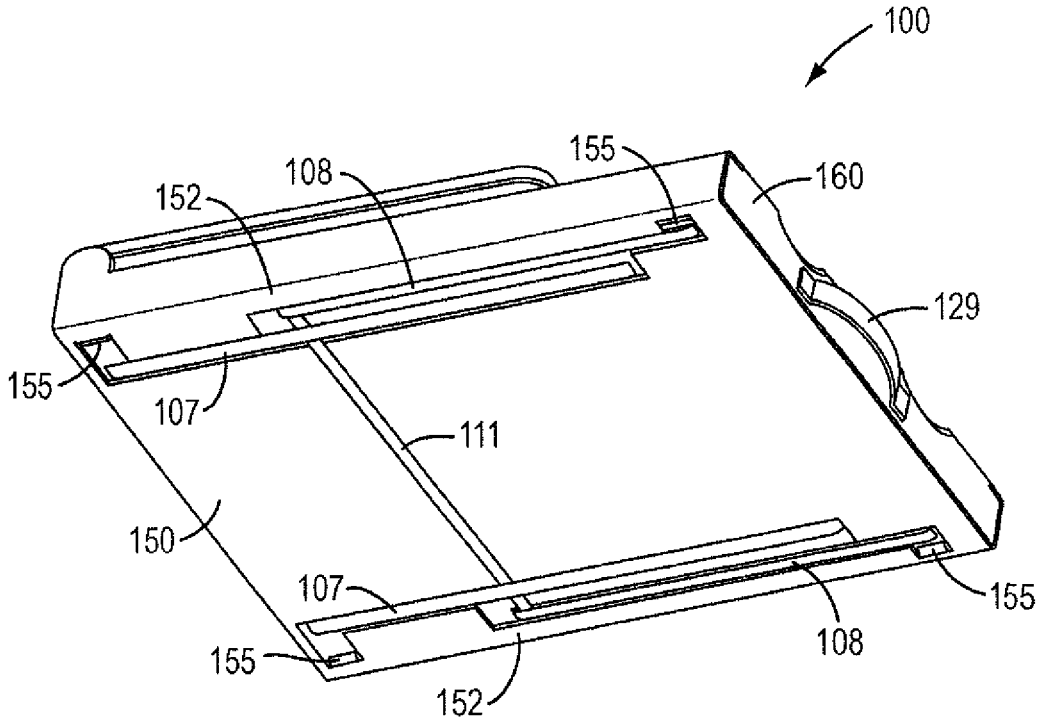
FIG. 6 is a bottom perspective view of the device of FIG. 1 in a portable configuration.

As illustrated in FIGS. 5 and 6, in various exemplary embodiments of the present teachings, to accommodate a broad range of users, including, for example, travelers, the device 100 may have a portable configuration. In the portable configuration, for example, the stand portion 116 (e.g., the base members 107 and the upright members 108 in the depicted exemplary embodiments) may rotate into alignment with the leg rest portion 102, thereby folding the stand portion against the lower surface 150 of the leg rest portion 102 for transportation or storage. Also, as shown in FIG. 5, the pedals 101 may be folded against the upper surface 140 of the leg rest portion 102 and secured to the leg rest portion 102 via the strap 114. Those ordinarily skilled in the art will further understand that the leg rest portion 102 and/or pedals 101 may comprise any type and/or configuration of mechanism to releasably secure the pedals 101 to the leg rest portion 102. As shown in FIGS. 1, 5, and 6, in various further embodiments, the leg rest portion 102 may comprise a handle 129, for example disposed at an upper edge 160 of the leg rest portion 102, to carry the device 100.

Figure 7:
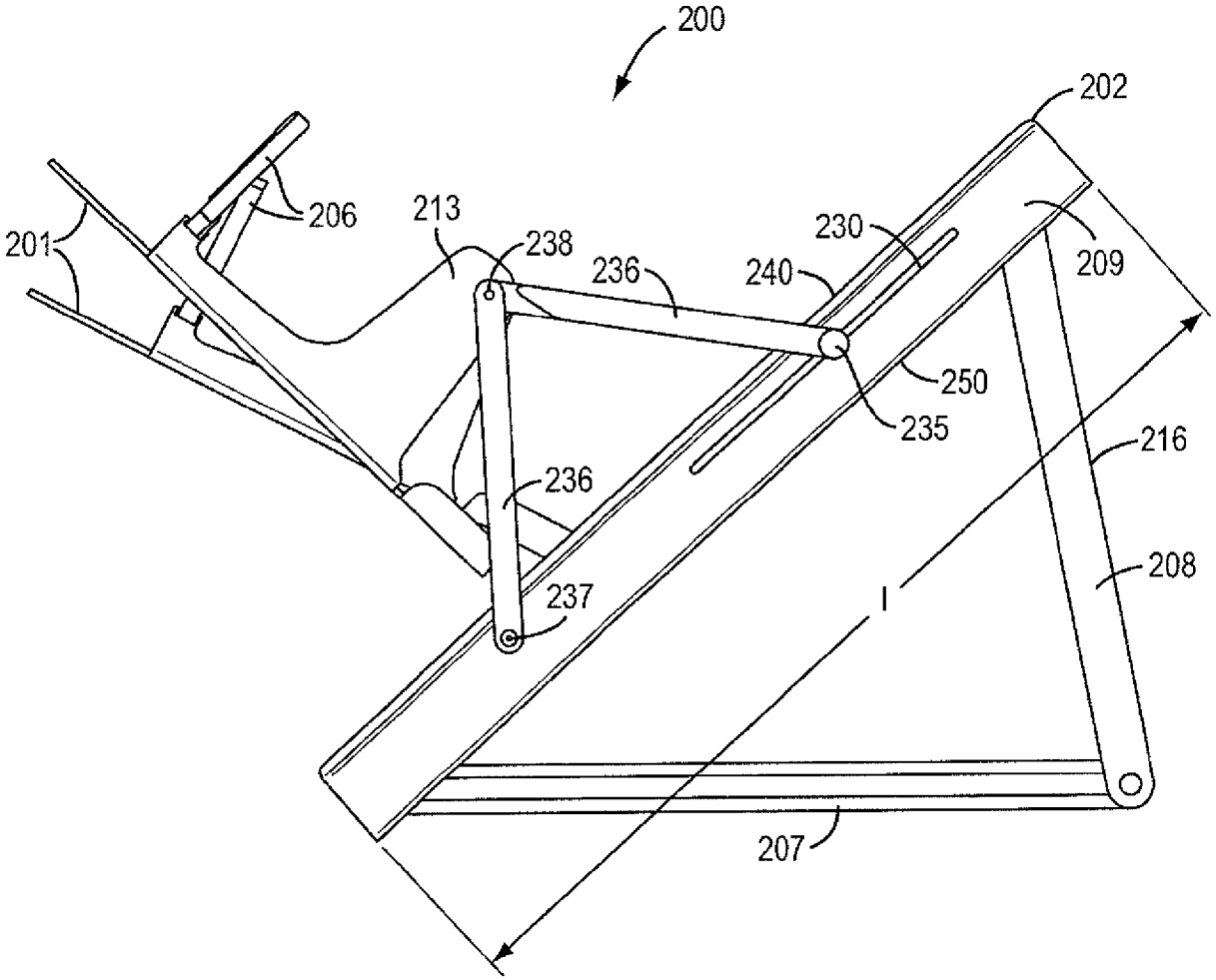
FIG. 7 is a side view of another exemplary embodiment of an exercise device in accordance with the present teachings in a first configuration for using the device.
Figure 8:
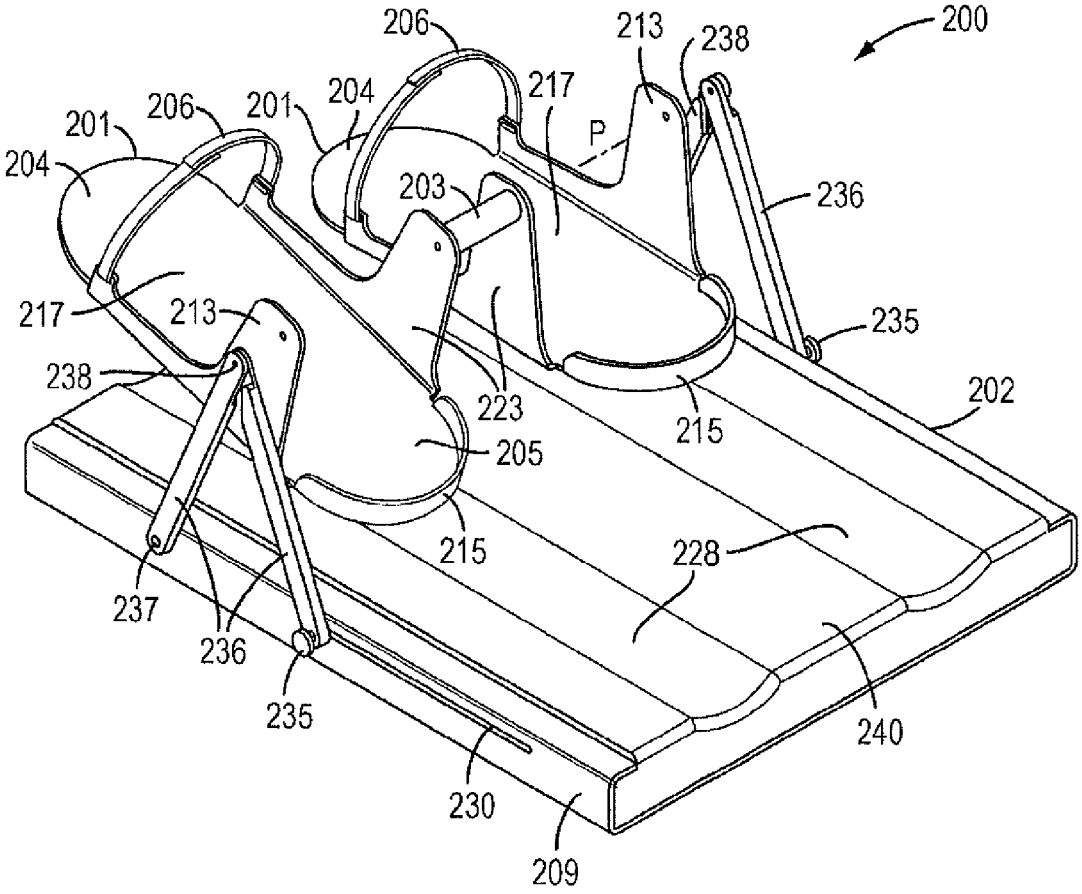
FIG. 8 is a top perspective view of the device of FIG. 7 in a second configuration for using the device.

FIGS. 7-11 illustrate an exemplary exercise device 200 in accordance with another exemplary embodiment of the present teachings. As shown in FIG. 7, the exercise device 200 includes a leg rest portion 202, one or more pedals 201 (two pedals 201 being shown in the embodiment of FIG. 7), and a stand portion 216. Similar to the embodiment of FIGS. 1-6, the leg rest portion 202 can provide a base from which the pedals 201 extend. As shown in FIGS. 7 and 8, the pedals 201 can extend from an upper surface 240 of the leg rest portion 202 via pedal support members 236 mounted on each side 209 of the leg rest portion 202.

As above, the upper surface 240 of the leg rest portion 202 is configured to receive and support the legs of a user. As shown in FIGS. 8-11, for example, the leg rest portion 202 may be shaped with depressions 228 configured to receive the legs of a user, being appropriately sized and/or configured to accommodate a range of user weights and/or heights (e.g., one size fits all). In the orientation of FIG. 7, upright members 208 of the stand portion 216 can attach to a lower surface 250 of the leg rest portion 202 to place the leg rest portion 202 in the position shown.

Figure 9:
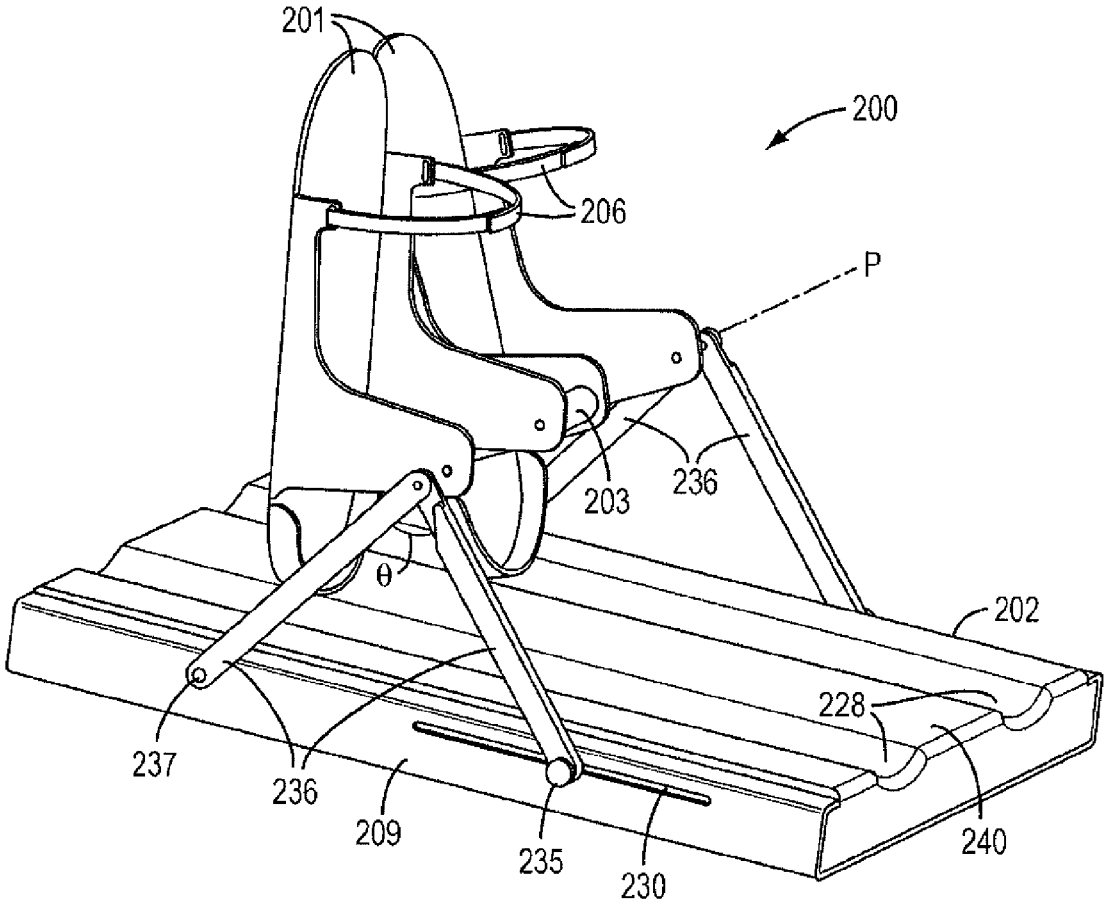
FIGS. 9 and 10 are perspective side views of the device of FIG. 7 in the second configuration for using the device.
Figure 10:
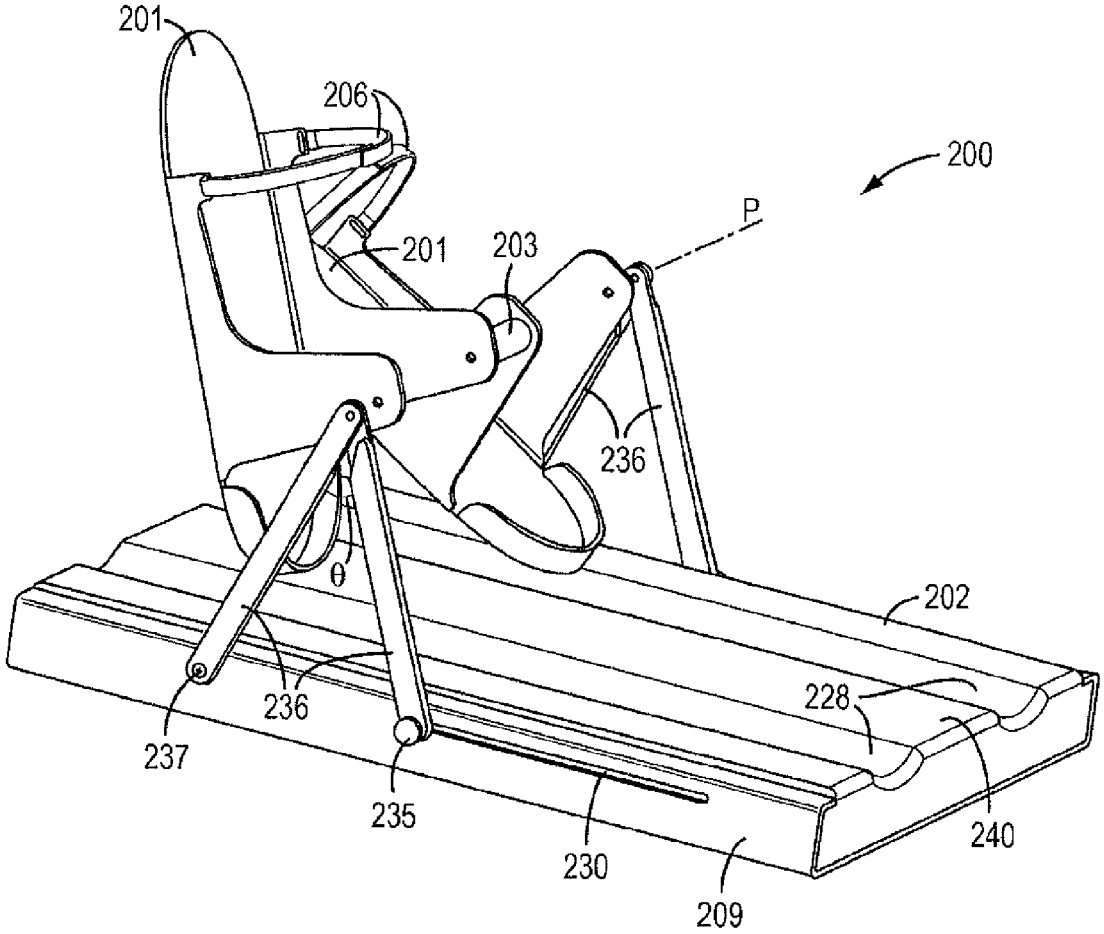

To comfortably accommodate a range of user heights, in various exemplary embodiments, the sides 209 of the leg rest portion 202 may comprise an adjustment mechanism to adjust a position of the pedals 201 on the leg rest portion 202. As shown in FIGS. 7-10, for example, in various embodiments, the adjustment mechanism may comprise a track 230 on each side 209 of the leg rest portion 202, in which a pin 235 may slide to adjust the position of pedals 201 with respect to the upper surface portion 240 of the leg rest portion 202. As would be understood by those of ordinary skill in the art, for example, as pin 235 slides within the track 230, the pedal support members 236 may rotate with respect to one another about pivot 238 (e.g., as illustrated in FIGS. 9 and 10, the angle θ formed by the pedal support members 236 at pivot 238 may increase and decrease) to adjust the position of the pedals 201 along the length l of the leg rest portion 202. When the pedals 201 are moved to an optimal position along the length of the leg rest portion 202, the pin 235 may be tightened to prevent further movement of the pin 235 within the track 230 (i.e. to secure the position of the pedal support members 236). In various exemplary embodiments, for example, the pin may comprise a threaded bolt that is tightened by applying a torque to the head of the bold that acts on the threads of the bolt.

As above, the pedals 201 can be shaped to receive a user's feet, and are sized to accommodate a range of foot and/or shoe sizes. In various exemplary embodiments, as shown in FIG. 8, the pedals 201 may each comprise a foot rest 217 having a toe end portion 204 and a heel end portion 205. As shown, in various additional embodiments, to comfortably accommodate each foot, the pedals 201 may each comprise a raised back portion 215 proximate to each heel end portion 205, which can provide a rest or stop for the user's heel. As before, however, those ordinarily skilled in the art will understand that the pedals 201 may have various sizes, shapes, configurations and/or features without departing from the scope of the present teachings. As above, for example, to secure each foot to a respective pedal 201, in various exemplary embodiments, the device 200 may further comprise at least one strap 206 affixed to each of the pedals 201 as illustrated in FIGS. 7-11 and similar to the straps 106 described above in the exemplary embodiments of FIGS. 1 and 2.

As illustrated in FIGS. 7 and 8, a pedal 201 may be pivotably mounted to each side 209 of the leg rest portion 202 via pedal support members 236, and the pedals 201 may be connected via a resistance mechanism in the form of a torsion bar 203. As shown, in various embodiments, a pair of pedal support members 236 may be mounted to each side 209 of the device 200. In various embodiments, for example, a bottom portion of each pedal support member 236 can be affixed to a side 209 via pins 235 and 237. A top portion of each pedal support member 236 can be pivotably mounted to a flange 213 at pivot 238. As shown in FIGS. 7 and 8, flanges 213 are disposed at an outer edge of and project updwardly from the foot rest portion 217 of each pedal 201. The torsion bar 203 can be disposed between the pedals 201 and mounted at its ends to flanges 223, which are disposed at an inner edge of and project upwardly from the foot rest portion 217 of each pedal 201. In this manner, the torsion bar 203 may connect the pedals 201, and allow the pedals 201 to pivot toward and away from the upper surface 240 of the leg rest portion 202 and can have a neutral position relative to a pivot axis P (see FIG. 9). As above, in the "neutral position", the pedal 201 is positioned at approximately 90 degrees relative to the upper surface 240 of the leg rest portion 202. The pedals 201 are configured to rotate about the pivot axis P in a first direction toward the upper surface 240 of the leg rest portion 202 (see the right pedal in FIG. 10) and in a second direction away from the upper surface 240 of the leg rest portion 202 (not shown).

As above, the torsion bar 203 is configured to resist an amount of torque that is placed upon it. In this manner, the torsion bar 203 is configured to exert a stored torque on the pedals 201 opposite to the direction of rotation (toward or away from the upper surface 240 of the leg rest portion 202) of the pedals 201 about the pivot axis P. In various exemplary embodiments, for example, the amount of stored torque (counteracting torque) respectively exerted by the torsion bar 203 on the pedals 201 is proportional to the amount by which the pedals 201 are rotated about the pivot axis P and away from the neutral position.

As explained in detail above with regard to the embodiment of FIGS. 1-6, to accommodate users in various positions, the device 200 may be adjustable to at least two configurations. As shown in FIG. 7, the device 200 may be adjusted to a first configuration wherein the pedals 201 are disposed to respectively receive the left foot and the right foot of a user in a sitting position. Alternatively, as shown in FIGS. 8-11, the device 200 may be adjusted to a second configuration wherein the pedals 201 are disposed to respectively receive the left foot and the right foot of a user in a supine position.

Figure 11:
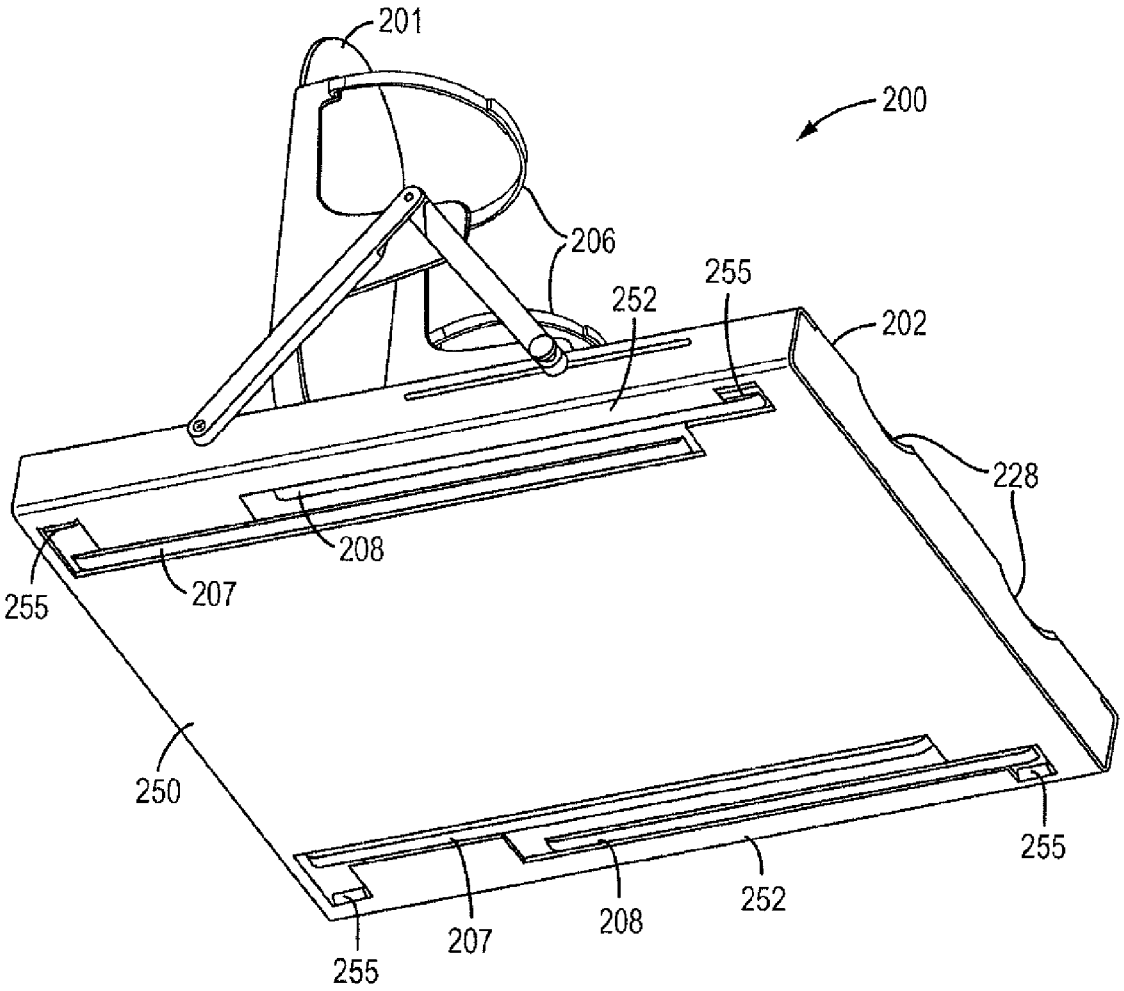
FIG. 11 is a bottom perspective view of the device of FIG. 7 in the second configuration for using the device.

Thus, as with the exemplary embodiment of FIGS. 1-6, in various exemplary embodiments, the device 200 includes a collapsible stand portion 216 configured to have a first expanded configuration that permits the device 200 to be placed in the configuration shown in FIG. 7 for use in a sitting position (e.g., to support the leg rest portion 202 at an incline relative to a flat surface), and a second collapsed configuration that permits the device 200 to be placed in the configuration shown in FIGS. 8-11 for use in a supine position. The stand portion 216 can include base members 207 and upright members 208. As shown in FIG. 7, when the device 200 is in the first configuration, the leg rest portion 202 may interconnect the base members 207 and the upright members 208 to form a triangular structure to receive the legs of a user in a sitting position. As shown in FIG. 11, in the collapsed second configuration, in various embodiments, for example, the members 207 and 208 are pivotably connected via pins 255 to inner edges 252 of the lower surface 250 of the leg rest portion 202. Thus, the base members 207 and the upright members 208 may rotate out from the lower surface 250 of the leg rest portion 202 to place the device 200 in the first configuration to form the stand portion 216 as shown in FIG. 7. To place the device 200 in the second configuration, the base members 207 and the upright members 208 may rotate back into the lower surface 250 so as to collapse the stand portion 216 as shown in FIGS. 8-11.

In accordance with various exemplary embodiments of the present teachings, an exemplary method for exercising muscles in an ankle, foot, and/or leg of a user 120 using the exercise device as illustrated in FIGS. 1-3 will now be described. For use in a sitting position, for example, the exercise device 100 may be placed in a first configuration, as shown in FIG. 2, by rotating base members 107 and upright members 108 out from the leg rest portion 102 to form a triangular structure, thereby placing the stand portion 116 in an expanded configuration. Alternatively, for use in a supine position, the exercise device 100 may be placed in a second configuration, as shown in FIG. 3, by folding the base members 107 and the upright members 108 against the lower surface 150 of the leg rest portion 102. This places the stand portion 116 in a collapsed configuration such that the leg support portion 102 can be placed substantially horizontally on a flat surface.

When used in either the sitting or supine position, at least one of the user's legs 122 and/or 127 can rest on the leg rest portion 102 and at least one foot 121 and/or 126 of the user 120 can be placed on the foot rest 117 of a pedal 101, and releasably secured to the pedal 101 by securing the respective strap 106 over the top of the foot. As shown in FIGS. 2 and 3, for example, various exemplary embodiments contemplate securing the left foot 121 and the right foot 126 respectively onto pedals 101 with straps 106. As above, by way of example only, various embodiments contemplate securing the left foot 121 and the right foot 126 respectively onto pedals 101 with hook and loop fasteners, such as, for example, Velcro®.

Figure 4A:
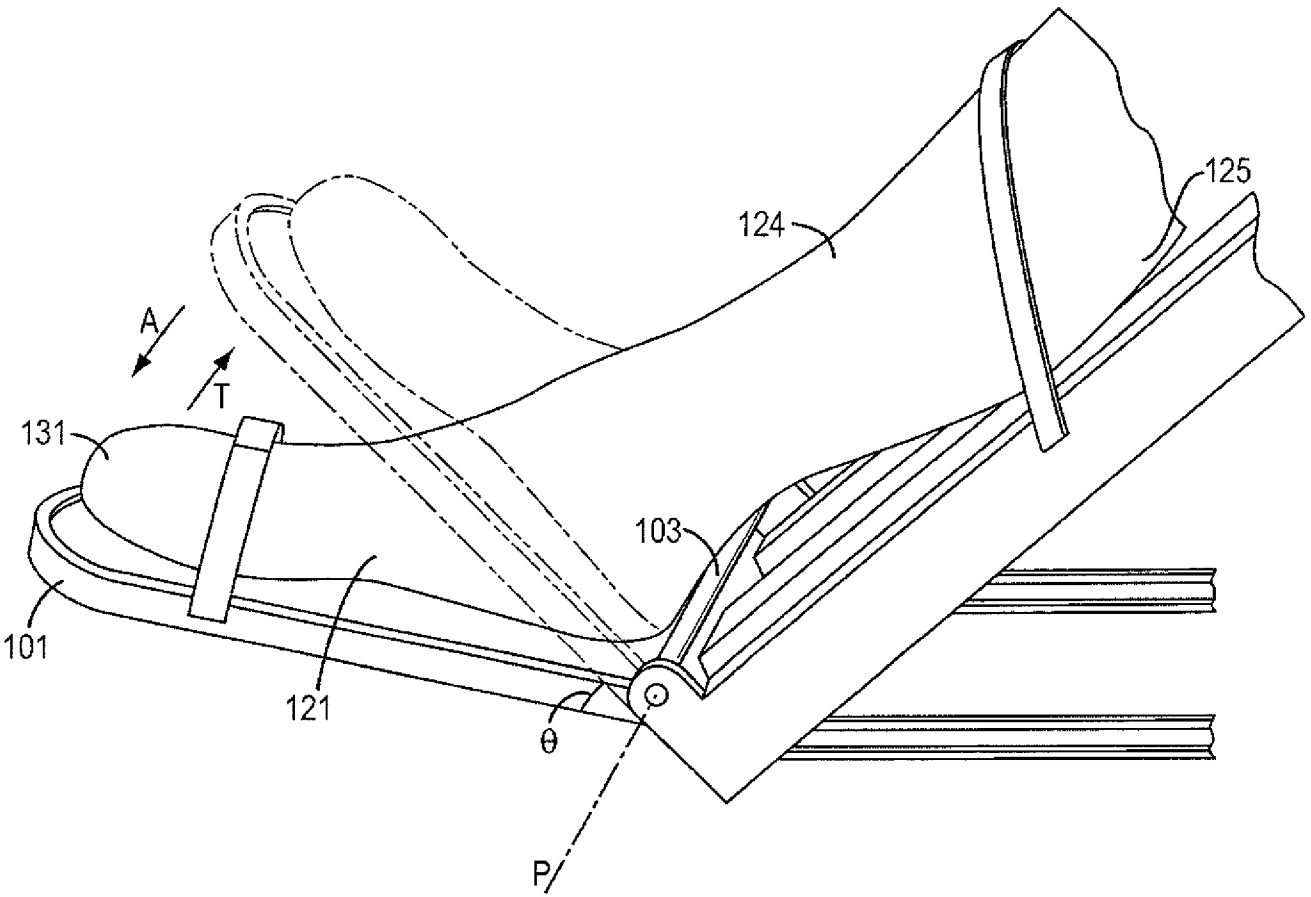
FIG. 4A is partial perspective side view of the device of FIG. 1 in the first configuration showing a user rotating a pedal of the device in a first direction.
Figure 4B:
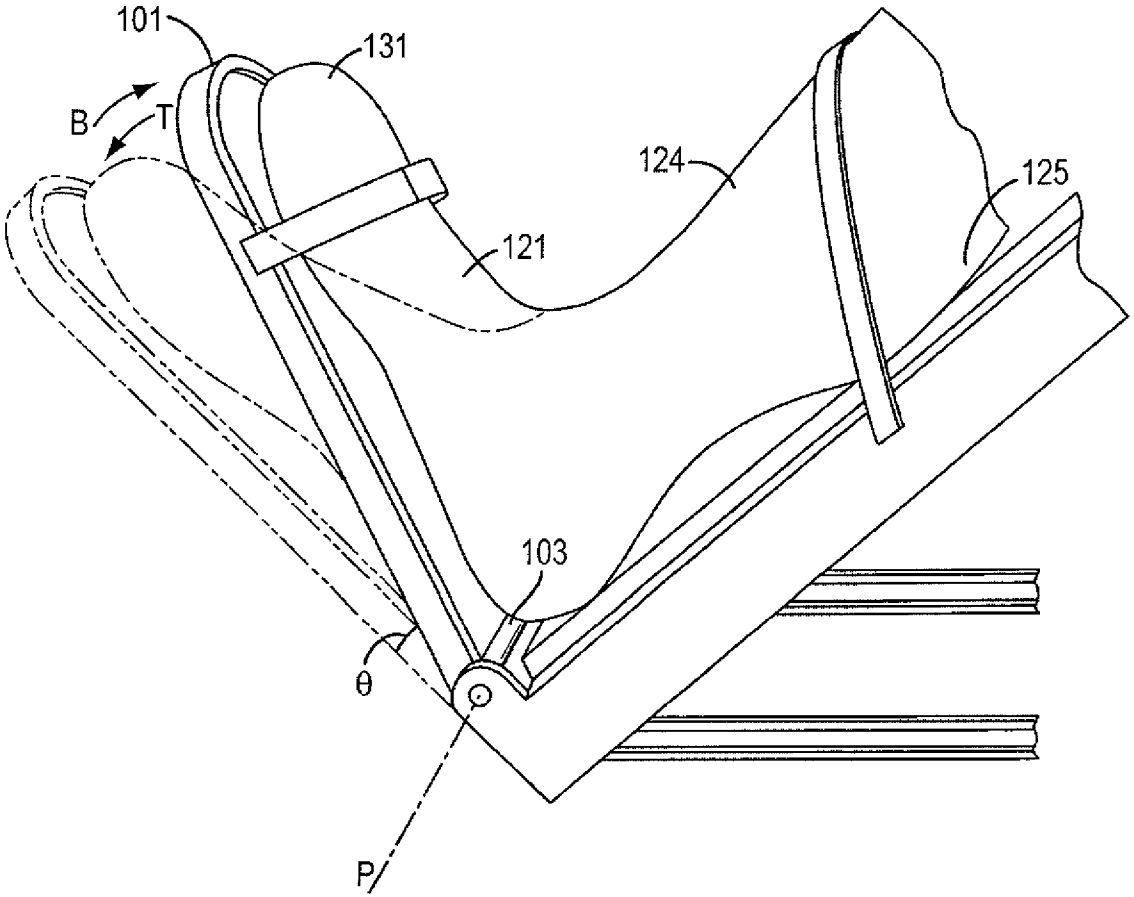
FIG. 4B is a partial perspective side view of the device of FIG. 1 in the first configuration showing a user rotating a pedal of the device in a second direction.

As also shown in FIGS. 2 and 3, upon initial use of the exercise device 100, the pedal(s) 101 may receive the user's at least one foot in the neutral position relative to a pivot axis P. As shown for illustrative purposes in FIGS. 4A and 4B for the left pedal 101, using the left foot 121, the user can rotate the pedal 101 in first and second opposite directions A and B about the pivot axis P (i.e., away from and toward the upper surface 140 of the leg support portion 102) against a stored torque T exerted against the pedal 101 in a direction opposite to the rotating direction (i.e., opposite to the direction A or B). Thus, in various exemplary embodiments, as illustrated in FIG. 4A, rotating the pedal(s) 101 in the first direction A comprises depressing the pedal 101 and, as shown in FIG. 4B, rotating the pedal(s) 101 in the second direction B comprises raising the pedal 101.

As explained above, in various exemplary embodiments, for example, an amount of the torque exerted against the pedal 101 may vary with a degree of rotation θ of the pedal 101 about the pivot axis P, for example, the amount of torque exerted against the pedal 101 may increase with the degree of rotation θ of the pedal 101 about the pivot axis P. In this way, the further away from the neutral position the user rotates pedal 101, the more force that is required by the user to maintain the position of the pedal 101.

Although not shown, using the right foot 126, similarly the user can rotate a right pedal 101 in first and second opposite directions A and B about the pivot axis P (i.e., away from and toward the upper surface 140 of the leg support portion 102) against a stored torque exerted against the pedal 101 in a direction opposite to the rotating direction (i.e., opposite to the direction A or B). And as explained above, in various exemplary embodiments, an amount of the torque exerted against the pedal 101 may vary with a degree of rotation θ of the pedal 101 about the pivot axis P, for example, the amount of torque exerted against the pedal 101 may increase with the degree of rotation θ of the pedal 101 about the pivot axis P.

Various exemplary embodiments of the present teachings, therefore, contemplate rotating the pedals 101 in the first and/or second opposite directions A and B to subject the corresponding foot 121 and/or 126 of a user to both plantar flexion motion (e.g., with reference of FIG. 4A. movement of the toes 131 of the left foot 121 away from the left shin 124, thereby contracting the left calf muscle 125) and dorsiflexion motion (e.g., with reference to FIG. 4B, movement of the toes 131 of the left foot 121 toward the left shin 124, thereby stretching the left calf muscle 125) respectively. In this manner, using the exercise devices in accordance with various exemplary embodiments of the present teachings can simulate a full ambulatory cycle for a user.

In various exemplary embodiments of the present teachings, for example, rotation of the pedals 101 in the direction A may subject the corresponding foot through up to about 75 degrees of plantar flexion (e.g., rotation ranging from about neutral to 75 degrees, or 90 degrees to about 165 degrees from the leg rest portion 102); and rotation of the pedals 101 in the direction B may subject the corresponding foot through up to about 60 degrees of dorsiflexion (e.g., rotation ranging from about neutral to −60 degrees, or 90 degrees to about 30 degrees from the leg rest portion 102).

Thus, as above, in various exemplary embodiments, the torsion bar 103 is configured to exert a stored torque T on the pedals 101 when the pedals 101 are rotated away from the neutral position (as shown in FIGS. 4A and 4B, wherein the neutral position is represented by the dotted lines), thereby simulating full ambulation for the user 120 using the exercise device 100. In various exemplary embodiments, the device 100 is, therefore, configured to exercise muscles in each ankle, foot, and/or leg of the user 120 to increase blood circulation. Those of ordinary skill in the art would understand that the torsion bar 103 may have various configurations, and may exert various amounts of torque to counteract the movement of the pedals 101. In various exemplary embodiments, for example, a user may adjust the amount of counteracting torque exerted by the torsion bar against the pedals to increase and/or decrease the amount of effort required to move the pedals. Accordingly, one of ordinary skill in the art would understand that the counteracting torque is a resistance that can vary based on the type of torsion bar used, and that the resistance of the torsion bar can be selected based on the person that is using the device 100. One of ordinary skill in the art would know how to select a torsion bar for the device based on the counteracting torque required for a selected application.

In general, the resistance provided by various exemplary devices in accordance with the present disclosure can be selected and the devices modified accordingly based on such factors as the age of a person for whom the device in intended, the relative strength or weakness of a person for whom the device is intended, the level of exercise desired, and other such factors that those of ordinary skill in the art would appreciate.

It will be appreciated by those ordinarily skilled in the art having the benefit of this disclosure that the present teachings provide various exemplary exercise devices and methods for exercising muscles in an ankle, foot, and/or leg useful for increasing blood circulation in the lower extremities of the body. Further modifications and alternative embodiments of various aspects of the present teachings will be apparent to those skilled in the art in view of this description. For example, although the particular examples and embodiments set forth herein contemplate an exercise device that receives one foot at a time (e.g., having a single pedal per foot), various additional exemplary embodiments in accordance with the present teachings contemplate an exercise device that receives both feet at once (e.g., having a single pedal sized to accommodate two feet), thereby simultaneously exercising muscles in both ankles, feet and/or legs.

Furthermore, the devices and methods may include additional components or steps that were omitted from the drawings for clarity of illustration and/or operation. Accordingly, this description is to be construed as illustrative only and is for the purpose of teaching those skilled in the art the general manner of carrying out the present teachings. It is to be understood that the various embodiments shown and described herein are to be taken as exemplary. Elements and materials, and arrangements of those elements and materials, may be substituted for those illustrated and described herein, parts and processes may be reversed, and certain features of the present teachings may be utilized independently, all as would be apparent to one skilled in the art after having the benefit of the description herein. Changes may be made in the elements described herein without departing from the spirit and scope of the present teachings and following claims, including their equivalents.

It is to be understood that the particular examples and embodiments set forth herein are non-limiting, and modifications to structure, dimensions, materials, and methodologies may be made without departing from the scope of the present teachings.

Furthermore, this description's terminology is not intended to limit the present teachings. For example, spatially relative terms—such as "beneath", "below", "lower", "above", "upper", "bottom", "right", "left" and the like—may be used to describe one element's or feature's relationship to another element or feature as illustrated in the figures. These spatially relative terms are intended to encompass different positions (i.e., locations) and orientations (i.e., rotational placements) of a device in use or operation in addition to the position and orientation shown in FIGS. 1-11.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present teachings. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present teachings have been described in detail with respect to various exemplary embodiments thereof, it should not be considered limited to such, as numerous modifications are possible without departing from the broad scope of the appended claims, including the equivalents they encompass.

We claim:

1. An exercise device comprising:

at least one pedal pivotably mounted to a leg rest portion and having a neutral position relative to a pivot axis, the pedal being configured to rotate about the neutral pivot axis in a first direction away from the neutral position and in a second direction away from the neutral position, wherein the second direction is opposite the first direction; and a counteracting force member configured to exert a force on the pedal about the pivot axis opposite to the respective first and second directions of rotation of the pedal about the pivot axis, wherein the device is configured to be placed in a first position in which the pedal is disposed in the neutral position to receive a foot of a user in a sitting position, and in a second position in which the pedal is disposed in the neutral position to receive a foot of a user in a supine position.

2. The exercise device of claim 1, further comprising at least one strap affixed to the at least one pedal, the strap being configured to releasably secure the foot of the user to the pedal.

3. The exercise device of claim 1, wherein the at least one pedal comprises a toe end portion and a heel end portion, the at least one pedal being pivotably mounted to the leg rest portion proximate the heel end portion.

4. The exercise device of claim 1, wherein the leg rest portion is configured to support at least one leg of the user in the sitting position and in the supine position.

5. The exercise device of claim 4, further comprising a stand portion mounted to the leg rest portion.

6. The exercise device of claim 5, wherein the stand portion is configured to support the leg rest portion in a position to receive the leg of a user in the sitting position when the device is in the first position.

7. The exercise device of claim 1, wherein the counteracting force member comprises a spring.

8. The exercise device of claim 1, wherein the force provides passive resistance to rotational movement of the pedal away from the neutral position.

9. The exercise device of claim 8, wherein an amount of the force varies with a degree of rotation of the pedal away from the neutral position.

10. The exercise device of claim 9, wherein the amount of force increases with the degree of rotation of the pedal away from the neutral position.

11. The exercise device of claim 1, wherein rotation of the pedal in the first direction subjects the foot of the user to plantar flexion and rotation of the pedal in the second direction subjects the foot of the user to dorsiflexion.

12. The exercise device of claim 1, wherein the device is configured to exercise muscles in an ankle, foot, and/or leg of the user to increase blood circulation.

13. The exercise device of claim 1, wherein the device is configured to be portable.

14. The exercise device of claim 1, wherein the leg rest portion further comprises an adjustment mechanism to adjust a position of the at least one pedal on the leg rest portion.

15. The exercise device of claim 1, wherein, in the first position, the leg rest is at an incline relative to a flat surface supporting the exercise device, and wherein, in the second position, the leg rest is substantially parallel to the flat surface.

16. The exercise device of claim 7, wherein the spring is a torsion spring.

17. An exercise device comprising:

at least one pedal pivotably mounted to a leg rest portion, the pedal having a neutral position relative to a pivot axis and being configured to rotate about the pivot axis in a first direction and a second direction opposite the first direction; and a counteracting force member configured to exert a force on the pedal about the pivot axis opposite to the respective first and second directions of rotation of the pedal about the pivot axis, wherein an amount of the force exerted by the member is variable.

18. The exercise device of claim 17, wherein the counteracting force member is configured to exert a passive resistance torque on the pedal.

19. A method for exercising muscles in an ankle, foot, and/or leg of a user, the method comprising:

adjusting a position of a leg rest to one of a first position and a second position, wherein, in the first position, the leg rest is configured to support a leg of a user in a sitting position, and wherein, in the second position, the leg rest is configured to support a leg of a user in a supine position;

setting at least one foot of the user onto at least one pedal pivotably mounted to the leg rest, the pedal having a neutral position relative to a pivot axis; and rotating the pedal with the at least one foot in first and second opposite directions about the pivot axis against a force exerted against the pedal in a direction opposite to the respective first and second directions.

20. The method of claim 19, wherein adjusting the position of the leg rest to the first position comprises placing the leg rest at an incline relative to a flat surface supporting the exercise device.

21. The method of claim 20, wherein adjusting the position of the leg rest to the second position comprises placing the leg rest substantially parallel to the flat surface.

22. The method of claim 19, wherein rotating the pedal in the first and second opposite directions subjects the at least one foot to plantar flexion motion and dorsiflexion motion respectively.

23. The method of claim 19, wherein rotating the pedal in the first direction comprises depressing the pedal and rotating the pedal in the second direction comprises raising the pedal.

24. The method of claim 19, wherein the force exerted varies with a degree of rotation of the pedal about the pivot axis and away from a neutral position.

25. The method of claim 19, further comprising releasably securing the at least one foot of the user onto the at least one pedal.

26. The method of claim 25, wherein releasably securing the at least one foot of the user onto the at least one pedal comprises securing the at least one foot onto the pedal with a strap.

* * * * *